US011562720B2

(12) United States Patent
McGee

(10) Patent No.: US 11,562,720 B2
(45) Date of Patent: Jan. 24, 2023

(54) ELECTROMECHANICAL DEVICE AND SYSTEM TO AUTOMATICALLY TUNE A DRUM ASSEMBLY WITHOUT HAVING TO STRIKE EITHER THE TOP OR BOTTOM SURFACE OF THE DRUM

(71) Applicant: Michael Dale McGee, Lake Havasu City, AZ (US)

(72) Inventor: Michael Dale McGee, Lake Havasu City, AZ (US)

( * ) Notice: Subject to any disclaimer, the term of this patent is extended or adjusted under 35 U.S.C. 154(b) by 346 days.

(21) Appl. No.: 16/985,707

(22) Filed: Aug. 5, 2020

(65) Prior Publication Data

US 2022/0044660 A1 Feb. 10, 2022

(51) Int. Cl.

| | |
|---|---|
| ***G10D 13/16*** | (2020.01) |
| ***G10D 13/20*** | (2020.01) |
| ***G10D 13/02*** | (2020.01) |
| ***G10L 25/51*** | (2013.01) |
| ***H04R 1/08*** | (2006.01) |
| ***H04R 3/04*** | (2006.01) |

(52) U.S. Cl.

CPC ..... *G10D 13/16* (2020.02); *G10D 13/02* (2013.01); *G10D 13/20* (2020.02); *G10L 25/51* (2013.01); *H04R 1/08* (2013.01); *H04R 3/04* (2013.01)

(58) Field of Classification Search

CPC ..... G10D 13/16; G10D 13/20; G10D 13/02; G10H 1/44

See application file for complete search history.

(56) References Cited

U.S. PATENT DOCUMENTS

2011/0252943 A1* 10/2011 Zuffante ..... G10D 13/02 84/413

FOREIGN PATENT DOCUMENTS

DE 3405283 A1 * 5/1985
JP 2008090058 A * 4/2008

* cited by examiner

*Primary Examiner* — Daniel J Colilla

(57) ABSTRACT

The present invention is a system and methods for automating the tuning process for drums. The invention automatically applies tension across the batter heads of a drum. The invention consists of a plurality of electrical stepper motors each of which is connected to a gear reduction assembly and a rotating tension rod. The invention acts to exert a tensioning force on each attachment point around the circumference of the hoop(s) securing the batter head to the drum shell. An algorithm drives a microprocessor that monitors the current being used by each stepper motor assembly which is translated to torque. When the torque for each stepper motor assembly reaches a predetermined level, the tension holding the batter head and to the shell of the drum will be in tune.

7 Claims, 9 Drawing Sheets

Drum Auto Tuner Devices Attached to Snare Drum

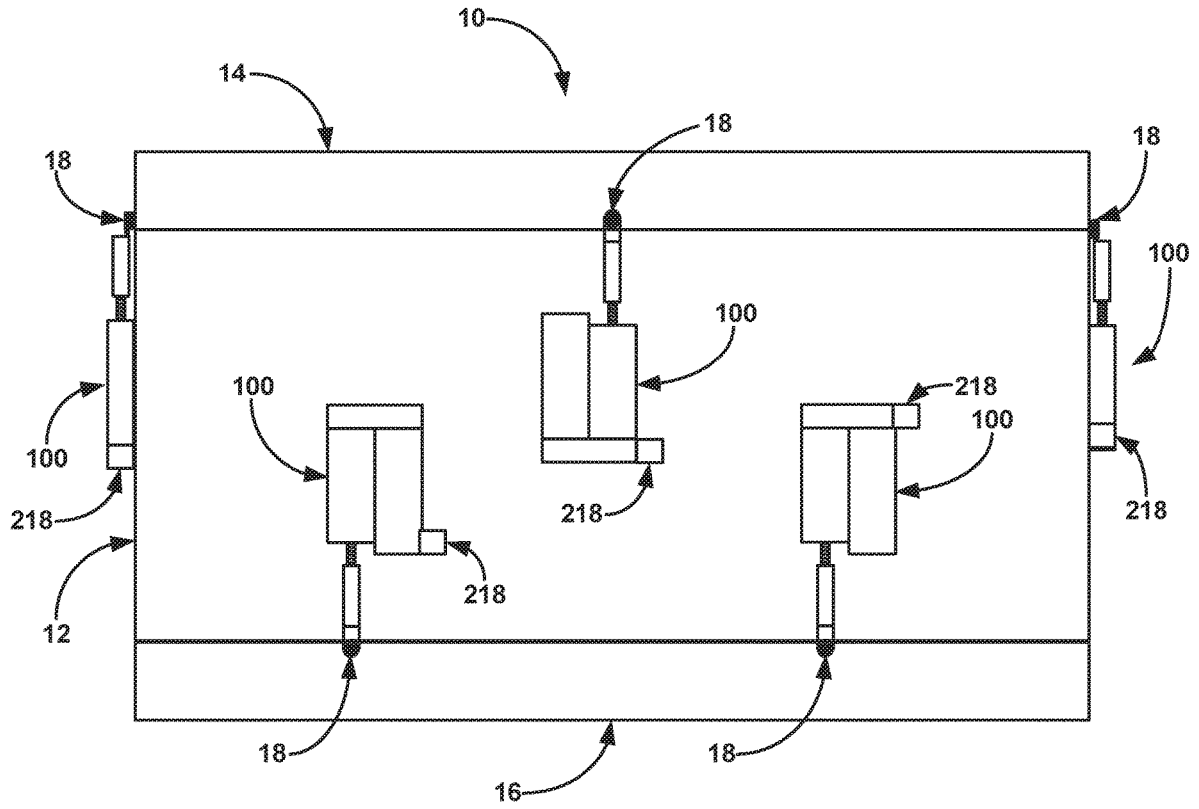
Figure 1 – Drum Auto Tuner Devices Attached to Snare Drum

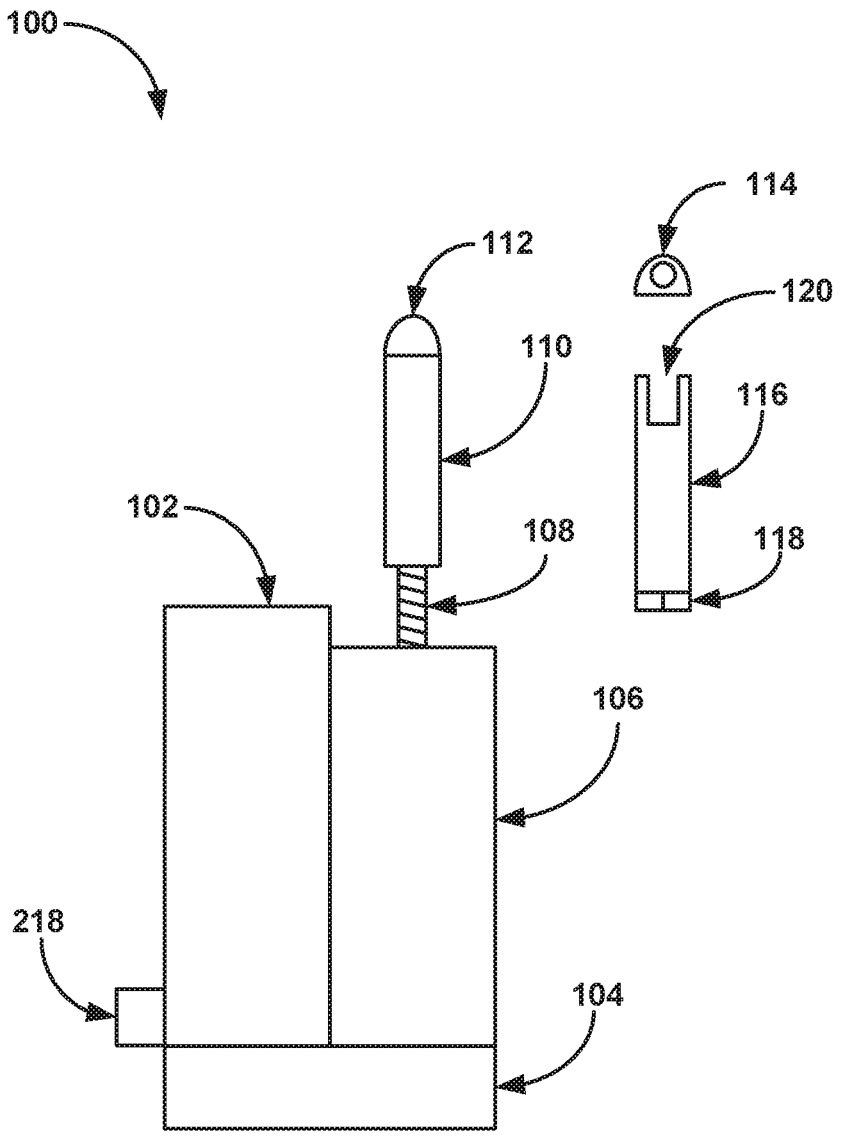
Figure 2 – Drum Auto Tuner Assembly

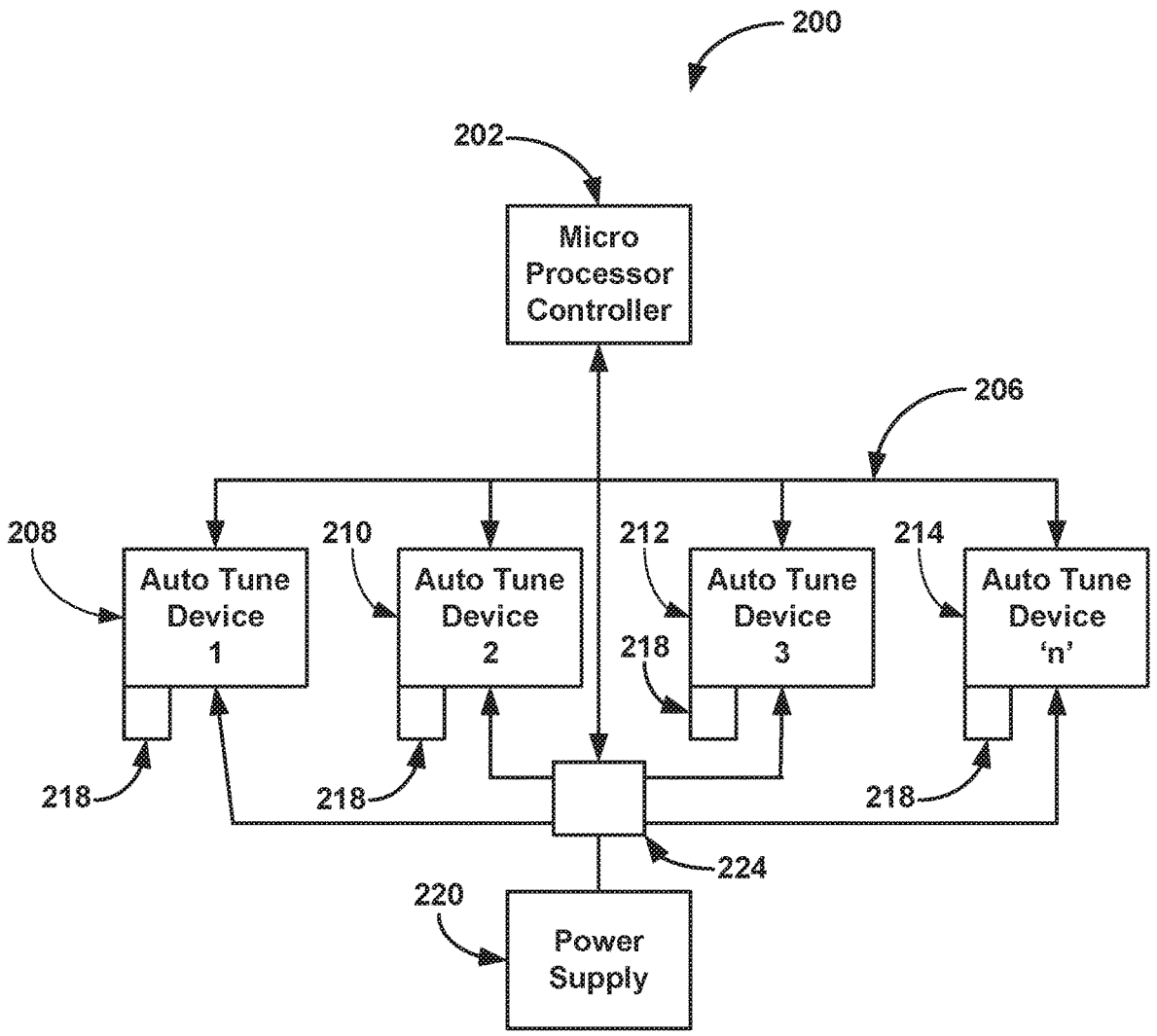
Figure 3 – Drum Auto Tuner Devices With Micro Controller

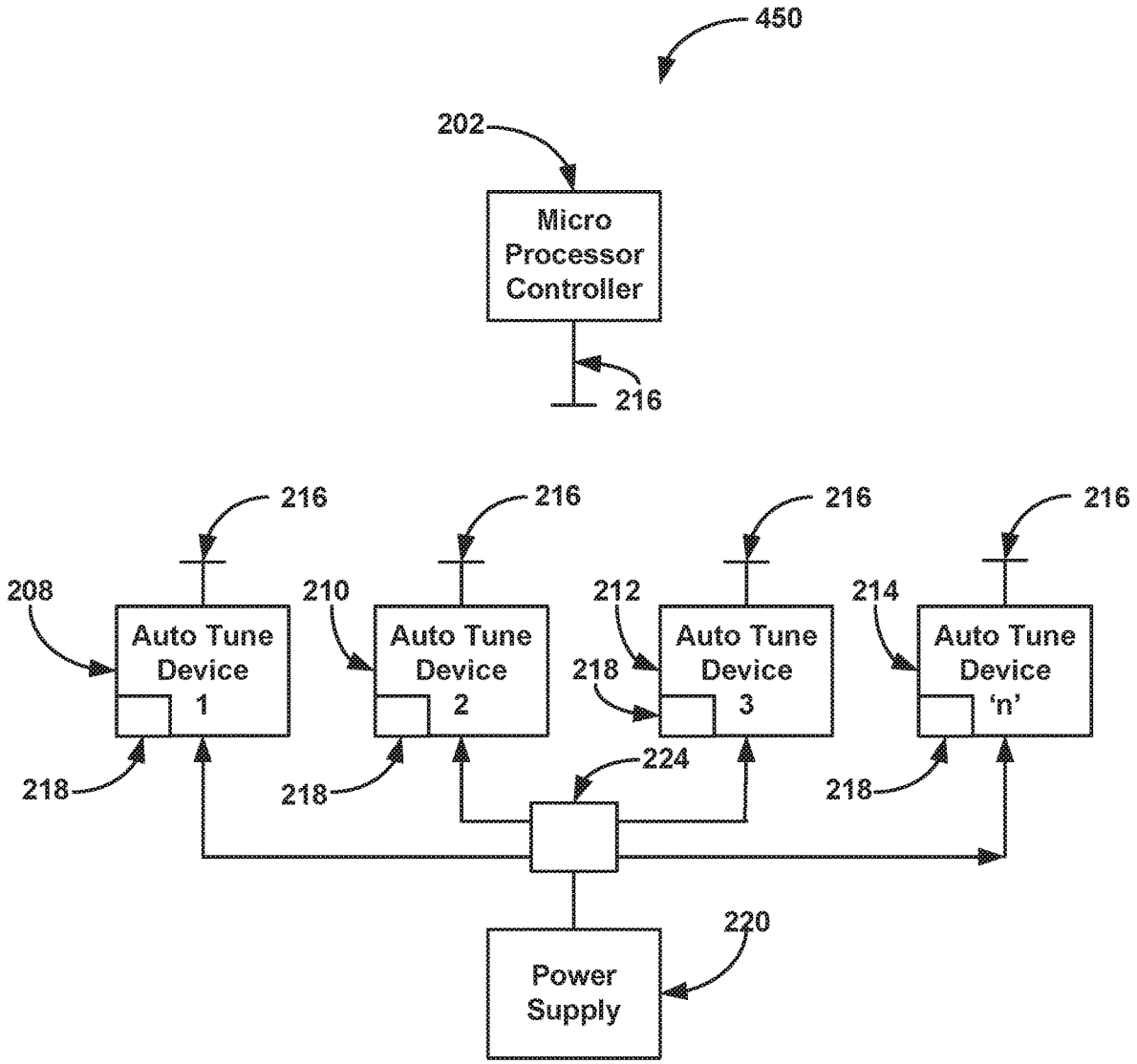
Figure 4 – Wireless Drum Auto Tuner Devices With Micro Controller

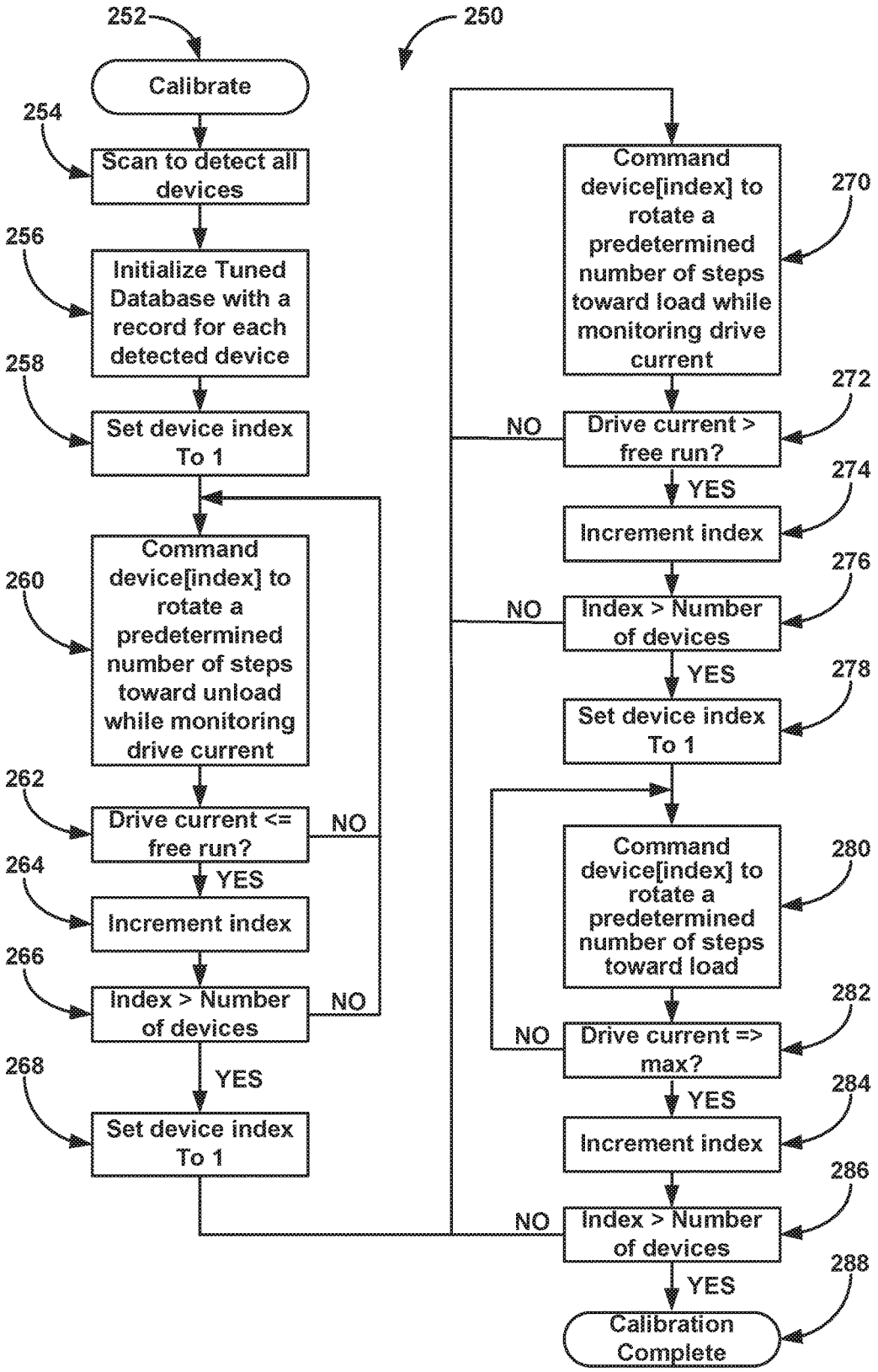
Figure 5 – Drum Calibration Sequence Flow

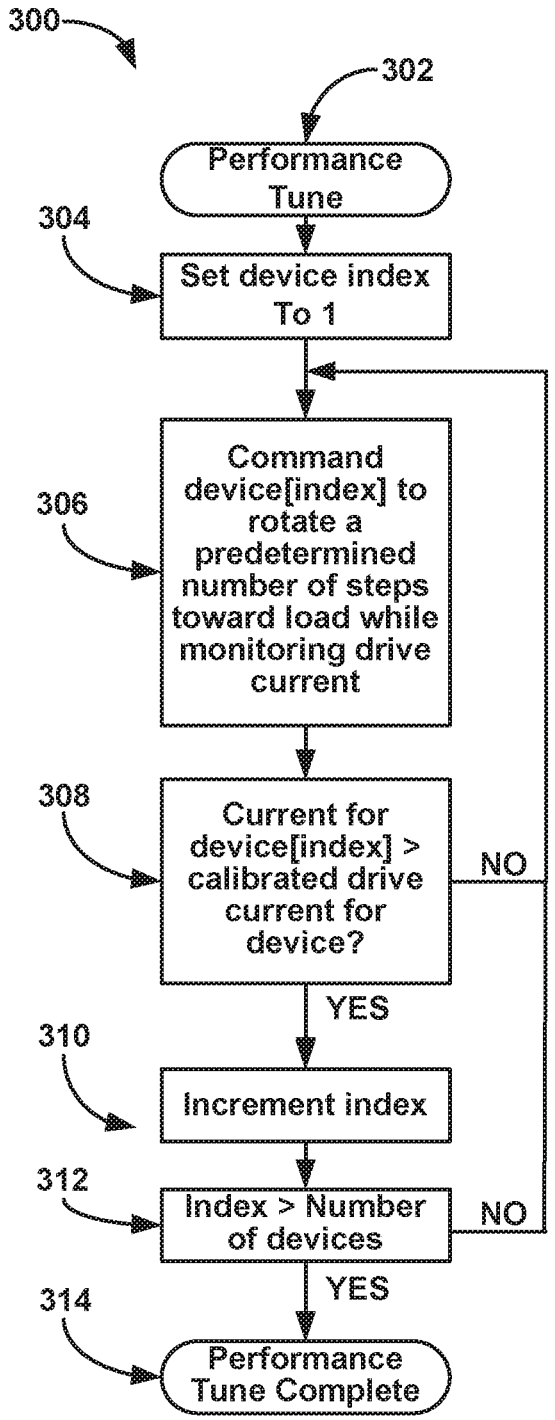
Figure 6 – Drum Performance Sequence Flow

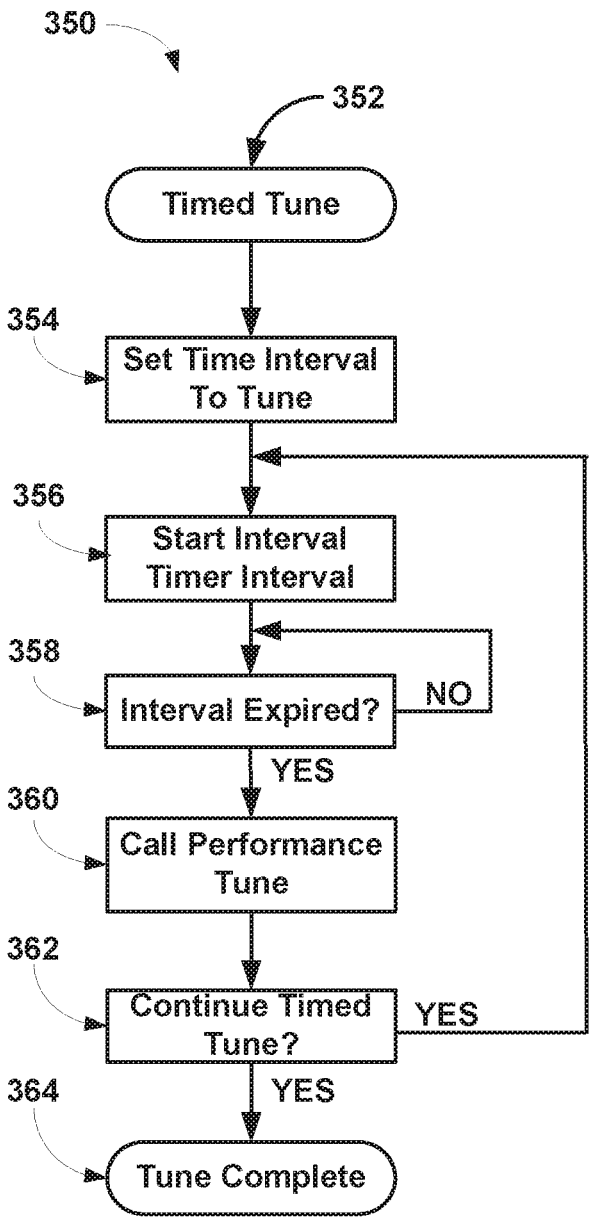
Figure 7 – Timed Tune Sequence Flow

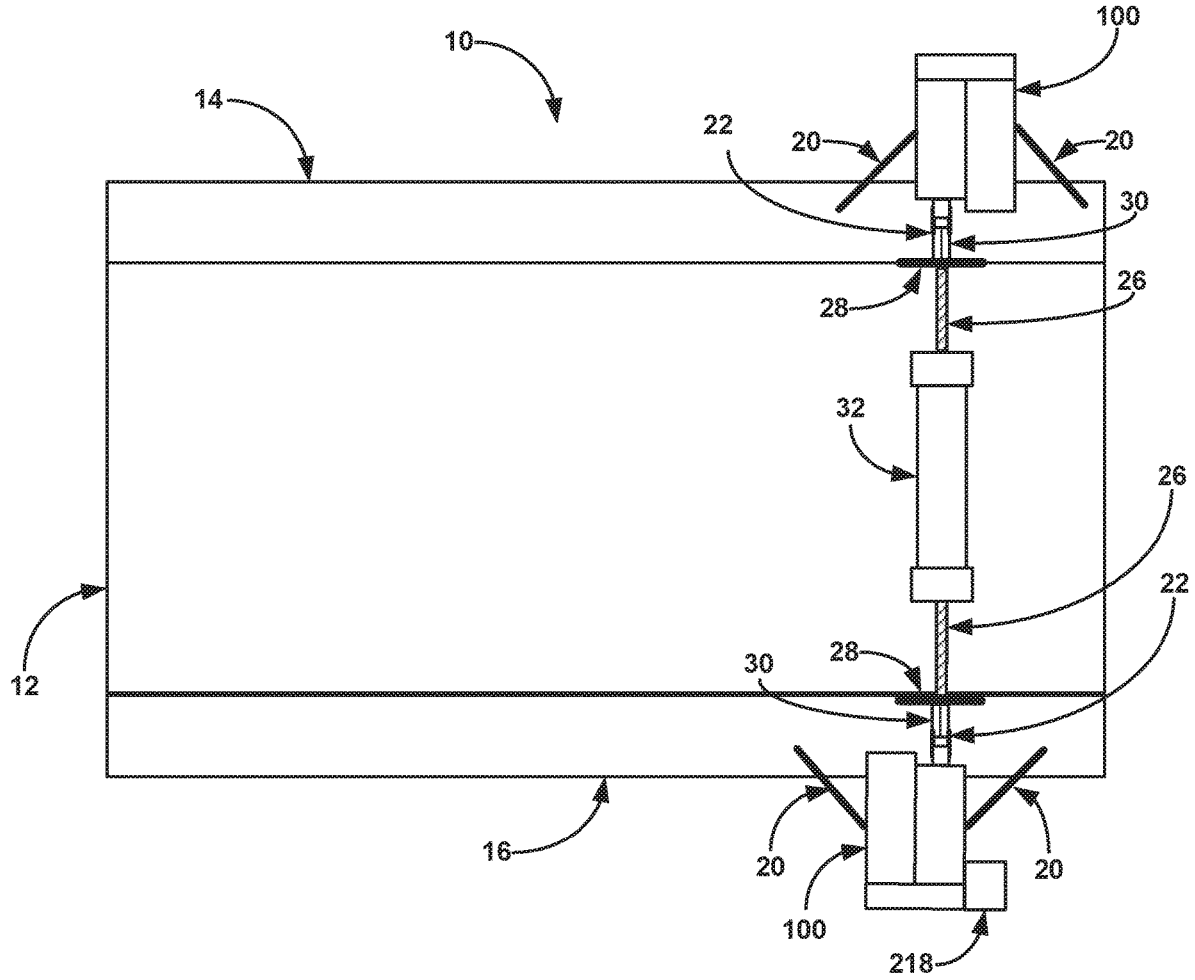
Figure 8 – Portable Auto Tuner Devices Attached to Snare Drum

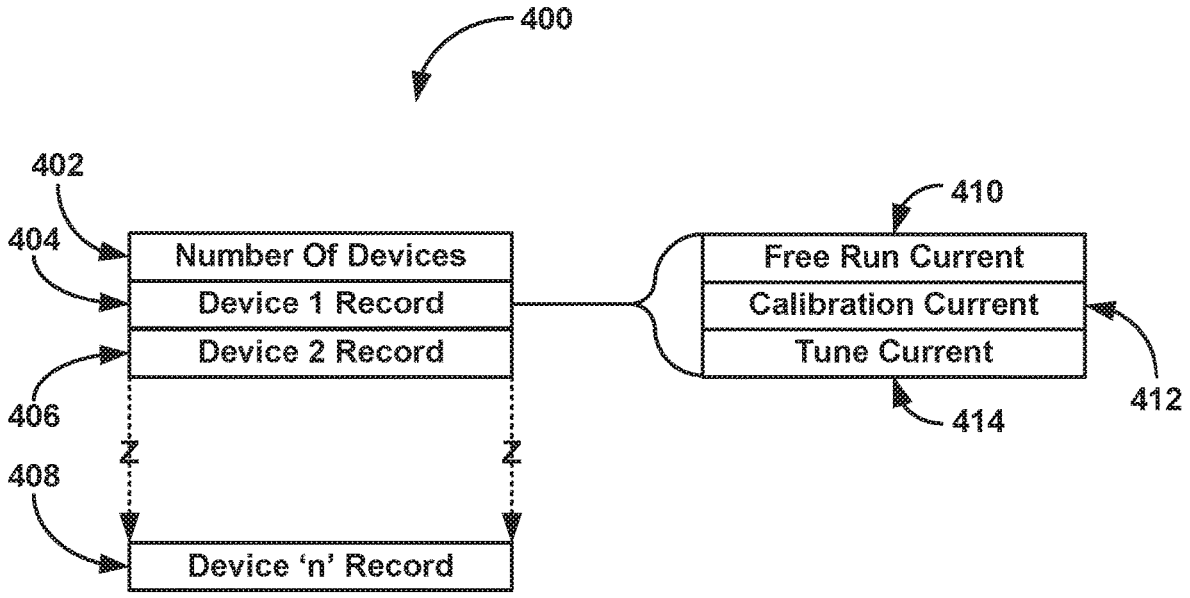
Figure 9 – Drum Tuner Database

ELECTROMECHANICAL DEVICE AND SYSTEM TO AUTOMATICALLY TUNE A DRUM ASSEMBLY WITHOUT HAVING TO STRIKE EITHER THE TOP OR BOTTOM SURFACE OF THE DRUM

FIELD OF INVENTION

The field of invention relates to electromechanical devices used to tune musical instruments.

DISCLOSURE

Michael McGee is the inventor of a mechanical drum tuner application filed Jan. 31, 2013 now granted U.S. Pat. No. 8,772,617 on Jul. 8, 2014.

BACKGROUND

Keeping stringed and percussion musical instruments in tune is a constant effort. Because of strings stretching, stringed instruments such as guitars generally need to be tuned before every practice use and for professional musicians, usually prior to every performance and generally "touched up" during performances. Live performance musicians playing stringed instruments will generally have multiple guitars sitting on stage or just off stage and a dedicated person to tune the instrument as it's traded off during performances for an in-tune guitar.

Percussion instruments, mainly drums, represent a completely different challenge. Drums by their very nature take longer to tune than guitars. Drums such as a "simple" snare drum contain more components that can effect the state of tune. The snare drum is composed of a hollow cylinder with a top service called the batter head and a bottom surface called a snare head. The batter and snare heads cover the ends of the cylinder/shell and are stretched under tension. Tension is maintained through a set of tension rods evenly spaced around the circumference of the drum shell. The tension rods are typically mounted to the side of the drum shell. The tension rods hold the counter hoops that retain the batter and snare heads. The counter hoops have holes evenly spaced around their circumference with the holes fitting over the ends of the threaded tension rods. Nuts secure the hoop rings to the tension rods and pull the heads down creating tension across the flexible surface of the heads. Drums generally contain 4 to 12 or more tension rods that are used to tune the surface heads by tightening and loosing the nuts retaining the hoop rings that stretch the surface heads.

A professional drum kit can contain anywhere from four to eight or more individual drums with each drum containing four or more tension rods with two nuts per tension rod giving 16 tuning points. A drum kit with five individual drums will have 80 tuning points. The time to tune a drum kit can take hours if done by ear and only slightly less time if an electronic frequency meter is used.

The challenge presented to tuning drums in orders of magnitude more difficult than tuning a guitar or other handheld stringed instrument.

Problem Statement

What is needed is some device or system to reduce both the time and the need for a skilled person to tune drum sets without needing a skilled ear or an electronic device to listen for a known frequency when the top or bottom surface of a drum is being struck by a drum stick.

SUMMARY

The instant invention discloses an automated electrically powered drum tuner controlled by a microprocessor and software. The invention may be portable and moved from one existing drum to another where the existing drums may have different numbers of tension rods and different numbers of drumming surfaces. The instant invention can be used to tune different diameters of drums ranging from small Toms in drum kits to large kettle drums to Conga drums without having to construct a mechanical support apparatus for adjusting the tension rod fixtures.

Embodiments

In a first exemplary embodiment, a drum tuning system is disclosed where in the system uses a plurality of stepper motor assemblies attached to the nuts mounted on the tension rods of a drum. The stepper motors are controlled by a microprocessor and electronic current monitors that can sense the force being used to tighten or loosen the nuts on the threaded tension rods. Once the stepper motors have applied a predetermined amount of force wherein each nut is being torqued with the same force, the surface of the batter and snare head with be in tune.

In a related embodiment, each stepper motor assembly is permanently attached to each tension rod. In this embodiment, the drum may be tuned in a matter of seconds once the tuning algorithm is initiated. This embodiment allows a drum to be tuned while being played since the state of tune is determined by the force applied to the hoop rings and not the frequency emitted as a result of heads being struck by the musician.

In a related embodiment, once initiated, the running algorithm detects when the drum is being played by monitoring a microphone attached to the interior of the drum shell. When the algorithm detects that the drum has not been struck for some predetermined number of seconds it will initiate a self-tuning sequence.

In another embodiment, a drum tuning system is disclosed wherein the system is portable and may be used to tune multiple different drums with different numbers of tension rods. In this embodiment the stepper motor assemblies are not fixed or attached to the tension rods but are individually attached to the top and bottom of the tension rods and capture each of the tension rods. The microprocessor monitoring the force being applied to the tension rods may have connections to more than the number of stepper motor assemblies. In this embodiment, the user indicates to the microprocessor the number of stepper motor assemblies required to be controlled.

Reference will now be made in detail to various embodiments, examples of which are illustrated in the accompanying drawings. Wherever possible, the same reference numbers will be used throughout the drawings to refer to the same or like parts.

Definitions

Snare Drum: basically a short cylinder with a drumhead at each end. The top head is struck with sticks and the bottom head is fitted with snares that vibrate sympathetically, giving the snare drum its distinctive "snap."

Air Hole: Allows air to escape the cylinder when the batter head is struck.

Batter Head: The top head that is struck with sticks or brushes. This drumhead is thicker than the snare head (the head on the bottom) to withstand the repetitive playing from the drumsticks.

Butt Plate: This part secures the snares on the shell opposite from the strainer.

Counter hoop: The rim or hoop that tightens the drumhead.

Lug Casing: This part receives the tension rod.

Shell: The body, of the drum. Shells can be made out of wood, metal, aluminum, and other materials.

Snares: Wire, cable, gut or synthetic materials that are stretched across the bottom head to produce a buzzing sound.

Snare Head: The bottom head, also known as the resonant head, is thinner than the hatter head (the head on the top). Snares are stretched over the snare head to allow them to vibrate when the batter head is played.

Snare Strainer: The mechanism that includes the snare strainer release and the snare strainer adjustment screw.

Snare Strainer Adjustment Screw: The screw that tightens or loosens the snares.

Snare Strainer Release: The lever mechanism that engages or disengages the snares on the snare head.

Tension Rod: A threaded metal rod that is inserted into the lug casing. The tension rod can be tightened or loosened to get the desired sound of the drumheads.

BRIEF DESCRIPTION OF THE DRAWINGS

FIG. 1 is a view of a snare drum and components including auto tuner devices.

FIG. 2 is a depiction of a drum auto tuner device.

FIG. 3 is a depiction of a drum auto tuner devices with a micro Controller

FIG. 4 is a depiction of wireless auto tuner devices with a micro Controller FIG. 5 is a flow chart for the drum calibration sequence FIG. 6 is a flow chart for the drum performance tune sequence FIG. 7 is a flow chart for the timed tune sequence FIG. 8 is a depiction of a snare drum with portable tuner devices FIG. 9 is a depiction of the drum tuner database

EMBODIMENTS

Reference will now be made in detail to various embodiments, examples of which are illustrated in the accompanying drawings. Wherever possible, the same reference numbers will be used throughout the drawings to refer to the same or like parts.

In a first exemplary embodiment an apparatus assembly and system is disclosed consisting of a tuning module containing a stepper motor, a gear transfer enclosure and a gear reduction device with a tension assembly. The tuning module is attached to the outer surface of the drum with the tension assembly fixed to the metal hoops that stretch the drum playing surface over one end of the drum cylinder. The tuning module is connected via a hard-wired cable assembly from a microprocessor to each of the tuning modules. The microprocessor executes a software program that sends commands, over the wired harness, to each of the tuning modules.

In a related embodiment, the wiring harness is replaced with a wireless transmitter and receiver for the microprocessor and each tuning module.

In another exemplary embodiment an apparatus assembly and system is disclosed consisting of a tuning module containing a stepper motor, a gear transfer enclosure and a gear reduction device. In this embodiment, the tuning module is attachable to an existing tension rod assembly fixed to the metal hoops that stretch the drum playing surface over one end of the drum cylinder. The tuning module is connected via a hard-wired cable assembly from a microprocessor to each of the tuning modules. The microprocessor executes a software program that sends commands, over the wired harness, to each of the tuning modules.

DETAILED DESCRIPTION OF THE INVENTION

Objects and advantages of the present invention will become apparent to those skilled in the art upon reading this description in conjunction with the accompanying drawings, in which like reference numerals have been used to designate like or analogous elements.

Now referencing FIG. 1 where 10 depicts a snare drum identifying its component parts. Snare drum 10 is composed of snare drum shell 12 which supports upper metal hoop 14 and lower metal hoop 16. Each of these hoops hold and stretch the drum surfaces. Support pins 18 are fixed to upper and lower metal hoops 14 and 16. The support pins hold the tensioning portion of auto tuner devices 100. Auto tuner devices 100, under control of a microprocessor controller 202, (shown in FIGS. 3 and 4) pull the upper metal hoop 14 down toward the center of snare drum shell 12 and pull the lower metal hoop 16 up toward the center of snare drum shell 12. Auto tuner devices 100 are fixed to snare drum shell 12 by one or a plurality of machine screws through snare drum shell 12 to auto tuner devices 100 or through a bonding material holding auto tune devices 12 to snare drum shell 21.

Now referencing FIG. 2 where 100 depicts the drum auto tuner device composed of stepper motor 102, gear transfer device 104 and gear reduction assembly 106. As stepper motor 102 is driven clockwise or counterclockwise rotational direction by microprocessor controller 202, (shown in FIGS. 3 and 4) stepper motor 102 turns and transfers torque through gear transfer device 104 to gear reduction assembly 106. Gear reduction assembly 106 multiplies the torque provided by stepper motor 102 through gear transfer enclosure 104. The revolutions per minute speed of stepper motor 102 is reduced by gear reduction device 106 which in turn increases the torque to tension assembly 108, 110, and 112. Tension assembly 108, 110, and 112 is composed of threaded drive screw 108 which in turn pulls or pushes threaded tension tube 110 toward auto tuner device increasing tension on metal hoops 14 or 16 or if stepper motor 102 turns in the opposite rotational direction, gear reduction assembly will push via threaded drive screw treaded tension tube 110 relaxing the tension on metal hoops 14 and 16. Metal connection band 112 connects threaded tension tube 110 to upper metal hoop 14 through metal support pins 18. Metal connect band 112 may be a band or a solid metal connector plate 114 with a hole the fits over metal support pins 18. In an alternate embodiment, threaded tension tube 110 is replaced with alternate threaded tension tube 116. Alternate threaded tube 116 is fixed on threaded drive screw 108 with jam nut 118. Alternate threaded tube contains a slotted cut 120 that fits onto tension rod fixture 30. In an alternate embodiment, tension rod fixture fits into alternate threaded tension tube 116 slotted end 120. When auto tune device 100 rotates threaded drive screw 108, tension rod fixture 30 rotates pulling upper metal hoop 14 or lower metal hoop 16 toward the center of snare drum cylinder 12 or loosens upper metal hoop 14 or lower metal hoop 16 removing tension on the drum surface.

Now referencing FIG. 3 where 200 depicts the control system that calibrates and maintains the tension applied by auto tune devices 100 between upper and lower metal hoops 12 and 14. Microprocessor controller 202 may be any computing device such as but not limited to a System On Chip single board computer, a smart phone, or a Personal Digital Assistant, computing tablet, laptop computer or desktop computer connected to communications bus 206 which may be a USB bus or other bus capable of connecting to a System On Chip single board computer, a smart phone, or a Personal Digital Assistant, computing tablet, laptop computer or desktop computer. Communications bus 206 is a bi-directional electronic bus and may be a USB bus, a two-conductor twisted pair serial bus, or any other bi-directional communications bus. Communications bus 206 also connects to electrical current switching device 224 which receives power from power supply 220 and provides switched electrical current to auto tune devices 208 through 214.

Microprocessor controller 202 executes software programs consisting of an operating system and software algorithms that perform the calibration and tuning functions of the invention. The number of auto tuner devices may vary depending on the size and configuration of the drum. Typically, a snare drum will have two tunable surfaces held in place by an upper metal hoop 14 and a lower metal hoop 16. Different drum types such as kettle drums may only have a single tunable drum surface.

The electrical current used to drive any of the auto tune devices is proportional to the amount of torque being created when stepping motor 102 is being actively stepped under control of microprocessor controller 202. The level of current delivered to each auto-tune device 208-214 is sensed by electrical current sensing device 218 to microprocessor controller 202 via Communications bus 206. Microprocessor controller saves the received sensor data in drum tuner database 400 (FIG. 9). The algorithms used to control microprocessor controller 202 are detailed in FIGS. 5, 6, and 7

Now referencing FIG. 4 where 450 depicts the control system that calibrates and maintains the tension applied by auto tune devices 100 between drum shell 12 and upper metal hoop 14 and lower metal hoop 16. Microprocessor controller 202 may be any computing device such as but not limited to a System On Chip single board computer, a smart phone, or a Personal Digital Assistant, computing tablet, laptop computer or desktop computer with wireless capability via any wireless protocol such as but not limited to WIFI, Bluetooth, or any proprietary wireless protocol capable of connecting to a System On Chip single board computer, a smart phone, or a Personal Digital Assistant, computing tablet, laptop computer or desktop computer. Microprocessor controller 202 executes software programs consisting of an operating system and software algorithms that perform the calibration and tuning functions of the system. The number of auto tuner devices may vary depending on the size and configuration of the drum. FIG. 4 depicts Microprocessor Controller communicable coupled to auto tune device 208 through auto tune device 214 via a wireless communications link received via antennas 216. The amount of current being used by any of the auto tune devices 208 through 214 is monitored by an auto tune device's electrical current sensing device 218. Electrical current sensing device 218 contains the electrical current monitoring circuitry and the necessary electronic circuitry for communicating over the wireless link to microprocessor controller 202 via antennas 216. Electrical current sensing device 218 sends a signal to microprocessor controller 202 that is an indication of the amount of current being used by any of the auto tune devices. The electrical current driving any of the auto tune devices is proportional to the amount of torque being created when stepping motor 102 is being actively stepped under control of microprocessor controller 202 via the wireless link. The algorithms used to control microprocessor controller 202 are detailed in FIGS. 5, 6, and 7. Microprocessor controller 202 receives signals from electronic module 218 indicating the amount of electrical current being supplied to each auto tune device 1-'n'. The level of electrical current delivered to each auto-tune device 208-214 as monitored by electrical current sensing device 218 and is saved in drum tuner database 400 (FIG. 8). The algorithms used to control microprocessor controller 202 are detailed in FIGS. 5, 6, and 7.

Now referencing FIG. 5 where 250 depicts a control algorithm used to initially calibrate a drum using the drum auto tune devices illustrated in FIGS. 1-4. Drum calibration sequence flow starts at process entry 252 calibrate then advances to process block 254. Process block 254 scans the hard-wired bus 206 in one embodiment or the wireless link supported by antennas 216 (FIG. 4). Each auto tune device 208-214 in FIG. 3 is individually addressed over communications bus 206. If a wireless embodiment is being described, as in FIG. 4 electronic module 218 attached or residing in each auto tune device communicates with Microprocessor controller 202 via a wireless protocol and antennas 216. In the wireless embodiment, electronic module 218 is individually addressed through the wireless protocol. Process block 256 initializes tuned database 400 to a default state where after control falls through to process block 258 which sets an index to the first entry into database 400 (FIG. 9) where after control falls through to process block 260. Process block 260 commands the stepper motor for auto tune device corresponding to the tuned database entry[index] and is commanded to rotate in the unload direction a predetermined number of steps while the drive current is being monitored after which control falls through to process block 262. Process block 262 compares the monitored drive current for the currently commanded auto tune device against the tuned database 400 entry[index].free run current. If the monitored drive current is equal to or less than tuned database 400 entry[index].free run current, control falls through to process block 264 else control is passed to process block 260 where that process block is repeated. If control fell through to process block 264, the index is incremented to the next entry in tuned database 400 after which control falls through to process block 266. If the value of the incremented index is greater than the last entry in tuned database 400, control falls through to process block 268 else control is passed to process block 260 where that process is repeated for the current auto tune device associated to the current entry in tuned database 400. If control fell through to process block 268, the index is set to the first entry into database 400 where after control falls through to process block 270. Process block 270 commands the stepper motor for auto tune device corresponding to the tuned database entry[index] to rotate in the load direction a predetermined number of steps while the drive current is being monitored after which control falls through to process block 272. Process block 272 compares the monitored drive current for the currently commanded auto tune device against the tuned database 400 entry[index].free run current. If the monitored drive current is greater than the tuned database 400 entry[index].free run current, control falls through to process block 274 else control is passed to process block 270 where that process block is repeated. If control fell through to process block 274, the index is incremented to the next entry in tuned database 400 after which control falls through to process block 276. Process block 276 determines if the value of the incremented index is greater than the last entry in tuned database 400 and if it is, control falls through to process block 278 else control is passed to process block 270 where that process is repeated. If control fell through to process block 278, the index into tuned database 400 is set to the first entry after which control falls through to process block 280. Process block 280 commands the stepper motor for auto tune device corresponding to the tuned database entry[index] to rotate in the load direction a predetermined number of steps while the drive current is being monitored after which control falls through to process block 282. Process block 282 compares the monitored drive current for the currently commanded auto tune device against the tuned database 400 entry[index].tuned drive current. If the monitored drive current is greater than or equal to tuned database 400 entry[index].tuned drive current, control falls through to process block 284 else control is passed to process block 280 where that process block is repeated. If control fell through to process block 284, the index is incremented to the next entry in tuned database 400 after which control falls through to process block 286. Process block 286 determines if the value of the incremented index is greater than the last entry in tuned database 400. If the value of the incremented index is greater than the last entry in tuned database 400, control falls through to process block 288 else control is passed to process block 280 where that process is repeated. If control fell through to process block 288, the calibration for all auto tune devices is completed and the drum calibration sequence algorithm exits.

Now referencing FIG. 6 where 300 depicts a control algorithm used to tune a drum during a performance using drum auto tune devices illustrated in FIGS. 1-4. Drum performance sequence algorithm flow starts at process entry 302 performance tune. This algorithm ensures that while a drummer is aggressively striking the drumming surface of the drum and causing the drumming surface to stretch and thus go slightly to greatly out of tune during the performance, the drum will be constantly brought back into tune while the instrument is being actively played. Once the algorithm is entered through process block 300, control falls through to processing block 304 where the index is set to the first entry into database 400 where after control falls through to process block 306. Process block 306 commands the stepper motor for the auto tune device corresponding to the tuned database entry[index] to rotate in the load direction a predetermined number of steps while the drive current is being monitored after which control falls through to process block 308. Process block 308 compares the monitored drive current for the currently commanded auto tune device against the tuned database 400 entry[index].calibrated drive current. If the monitored drive current is greater than or equal to the tuned database 400 entry[index].calibrated drive current, control falls through to process block 310 else control is passed to process block 306 where that process block is repeated. If control fell through to process block 310, the index is incremented to the next entry in tuned database 400 after which control falls through to process block 312. Process block 312 determines if the value of the incremented index is greater than the last entry in tuned database 400. If the value of the incremented index is greater than the last entry in tuned database 400, control falls through to process block 314 else control is passed to process block 308 where that process is repeated. If control fell through to process block 314, the performance tune for all the auto tune devices is completed and the performance tune sequence algorithm exits.

Now referencing FIG. 7 where 350 depicts an algorithm that, while a drum is actively being played, a timer interval is set and when it expires, a performance tune algorithm 300 will be called (FIG. 6). Performance algorithm 300 when executed will retune the auto tune devices 208-214 (FIGS. 2 and 3) then will exit back to timed tune 350 where that algorithm is repeated until the algorithm is exited at the end of the performance. When timed tune 350 is started, entry into the algorithm is via process block 352 where control falls through to process block 354 where the timer interval is set. This interval may be relatively short for a performance where the drum is aggressively played to a relatively long interval where the drum is only occasionally played. For example, a heavy metal rock band using fast drumming may have the interval set to a few seconds whereas a classical symphony may have the interval for a kettle drum set to a minute or more. After the interval is set control falls through to process block 356 where the interval timer is started after which control falls through to process block 358. Process block 358 checks the interval timer and if the timer has not expired, control will be returned to process block 358. If the interval timer has expired, control will fall through to process block 360. Process block 360 calls process block 300 performance tune entry. After the called performance tune 300 returns, control falls through to process block 362 continue timed tune. If the performance is not finished, control will be passed to process block 356 start interval timer where the process is repeated. If the performance is finished, control will fall through to process block 364 which exits the timed tune algorithm 350.

Now referencing FIG. 8 where a portable embodiment of the instant invention is described. FIG. 8 depicts a snare drum 12 with an upper metal hoop 14 and a lower metal hoop 16. Each of the metal hoops secures a drum surface to the snare drum cylinder 12. In this depiction only one of a plurality of tension rod assemblies are shown consisting of tension rod body 32 with tension rods 26 threaded into tension rod body 32. Each tension rod 26 passes through a flange 28 attached to or is part of upper metal hoop 14 or bottom metal hoop 16. A tension nut 30 is threaded onto each tension rod and bares onto flange 28 which pulls upper metal hoop 14 or lower metal hoop 16 toward the center of snare drum cylinder 12. Tension nut 30 is normally tightened by the person who tunes the drum. In this embodiment, a drum auto tuner device 100 is mounted onto the rim and the outside of upper metal hoop 14 and lower metal hoop 16. Now referencing FIG. 2 where 100 depicts the drum auto tuner device composed of stepper motor 102, gear transfer enclosure 104 and gear reduction device 106. As stepper motor 102 is driven by microprocessor controller 202, (not shown) stepper motor 102 turns and transfers torque through gear transfer enclosure 104 to gear reduction device 106. Gear reduction device 106 multiplies the torque provided by stepper motor 102 through gear transfer enclosure 104. The revolutions per minute speed of stepper motor 102 is reduced by gear reduction device 106 which in turn increases the torque to tension assembly 108, 110, and 112. Tension assembly 108, 110, and 112 is composed of threaded drive screw 108 which in turn pulls or pushes threaded tension tube 110 toward upper or lower metal hoops 14 or 16. In this embodiment, threaded tension tube 110 is replaced with alternate threaded tension tube 116. Alternate threaded tube 116 is fixed on threaded drive screw 108 with jam nut 118. Alternate threaded tube contains a slotted cut 120 that fits onto tension rod fixture 30. In present embodiment, tension rod fixture 30 fits into alternate threaded tension tube 116 slotted end 120. When auto tune device 100 rotates threaded drive screw 108, tension rod fixture 30 rotates pulling upper metal hoop 14 or lower metal hoop 16 toward the center of snare drum cylinder 12 or loosens upper metal hoop 14 or lower metal hoop 16 removing tension on the drum surface.

Now referencing FIG. 9 where 400 depicts tuned database 400. Tuned database 400 contains entry 402 Number Of Devices. This entry is the number of autotune device for the drum the invention is currently operating on. Each autotune device mounted on said drum has a record in tuned database 400. Record entries 404-408 contain record entries 410 through 414. Record entry 410 free run current is the electrical current consumed by stepper motor 102 when of auto tune device 100 is not encountering resistance loading via gear transfer device 103 communicably coupled to gear reduction assembly 106. Record entry 412 is the amount of level of electrical current used by auto tune device 100 when drum tuner device was initially calibrated. Record entry 414 is the level of electrical current used by auto tune device 100 when the drum was brought into tune.

Although only a few embodiments have been disclosed in detail above, other embodiments are possible, and the inventor intends these to be encompassed within this specification. The specification describes specific examples to accomplish a more general goal that may be accomplished in another way. This disclosure is intended to be exemplary, and the claims are intended to cover any modification or alternative which might be predictable to a person having ordinary skill in the art. For example, while the disclosure describes certain kinds and forms of busses, this disclosure can be used with other forms and kinds of busses.

Those of skill would further appreciate that the various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the exemplary embodiments of the invention.

The various illustrative logical blocks, modules, and circuits described in connection with the embodiments disclosed herein, may be implemented or performed with a general purpose processor, a Digital Signal Processor (DSP), an Application Specific Integrated Circuit (ASIC), a Field Programmable Gate Array (FPGA) or other programmable logic device, discrete gate or transistor logic, discrete hardware components, or any combination thereof designed to perform the functions described herein. A general-purpose processor may be a microprocessor, but in the alternative, the processor may be any conventional processor, Controller, Micro-Controller, or state machine. A processor may also be implemented as a combination of computing devices, e.g., a combination of a DSP and a microprocessor, a plurality of microprocessors, one or more microprocessors in conjunction with a DSP core, or any other such configuration. These devices may also be used to select values for devices as described herein.

The steps of a method or algorithm described in connection with the embodiments disclosed herein may be embodied directly in hardware, in a software module executed by a processor, or in a combination of the two. A software module may reside in Random Access Memory (RAM), flash memory, Read Only Memory (ROM), Electrically Programmable ROM (EPROM), Electrically Erasable Programmable ROM (EEPROM), registers, hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

In one or more exemplary embodiments, the functions described may be implemented in hardware, software, firmware, or any combination thereof. If implemented in software, the functions may be stored on or transmitted over as one or more instructions or code on a computer-readable medium. Computer-readable media includes both computer storage media and communication media including any medium that facilitates transfer of a computer program from one place to another. A storage media may be any available media that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk, solid state drives (SSD) and Blu-ray disc where disks usually reproduce data magnetically, while discs reproduce data optically with lasers. Combinations of the above should also be included within the scope of computer-readable media.

Also, the inventor intends that only those claims which use the words "means for" are intended to be interpreted under 35 USC 112, sixth paragraph. Moreover, no limitations from the specification are intended to be read into any claims, unless those limitations are expressly included in the claims. The computers described herein may be any kind of computer, either general purpose, or some specific purpose computer such as a workstation. The programs may be written in C, or Java, Brew or any other programming language. The programs may be resident on a storage medium, e.g., magnetic or optical, e.g. the computer hard drive or solid-state drive, a removable disk or media such as a memory stick or SD media, or other removable medium. The programs may also be run over a network, for example, with a server or other machine sending signals to the local machine, which allows the local machine to carry out the operations described herein.

Where a specific numerical value is mentioned herein, it should be considered that the value may be increased or decreased by 20%, while still staying within the teachings of the present application, unless some different range is specifically mentioned. Where a specified logical sense is used, the opposite logical sense is also intended to be encompassed.

The previous description of the disclosed exemplary embodiments is provided to enable any person skilled in the art to make or use the present invention. Various modifications to these exemplary embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

I claim:

1. A system for automatically tuning a musical drum instrument in combination with said musical drum instrument comprising:

a plurality of auto tune devices;

a plurality of tension assemblies, one of each of the plurality of tension assemblies associated with one of the plurality of auto tune devices, respectively;

at least one hoop retaining a drum surface against said musical drum instrument and said at least one hoop containing attachment points for attaching each auto tune device;

a computing device hosting a software program;

a communications bus;

an electrical current distribution bus;

a plurality of electrical current sensing devices, one of each of the plurality of electrical current sensing devices associated with one of the plurality of auto tune devices, respectively; and an electrical current switching device, a. wherein each said auto tune device comprises:

a bidirectional stepper motor;

a gear transfer assembly; and a gear reduction assembly, wherein said gear transfer assembly communicatively couples said bidirectional stepper motor and said gear reduction assembly, and said gear reduction assembly reduces rotational input speed from said bidirectional stepper motor thereby increasing the output torque of said gear reduction assembly;

b. each of said plurality of tension assemblies comprising:

a hollow threaded tube communicably coupled to the output end of said gear reduction assembly of said auto tune device via a threaded rod transferring torque to said tension assembly that applies tension to said at least one hoop and said drum surface by pulling said at least one hoop in a direction toward a respective one auto tune device of said plurality of auto tune devices and relieves tension on said at least one hoop and said drum surface by allowing said hoop to move in a direction away from said respective one auto tune device;

c. a computing device comprising:

i. a communication bus communicably coupling said computing device to each of said auto tune devices and to said electrical current switching device;

ii. a software program controlling each of said auto tune devices by sending commands via said communications bus and said electrical switching device;

d. an electrical current switching device wherein said electrical current switching device is communicably coupled to said computing device via said communications bus and communicably coupled to each of said auto tune devices thereby providing switched electrical current to activate and deactivate each of said auto tune devices, e. wherein said computing device is under control of said software program when tuning said musical drum instrument, wherein said first software program is configured to send commands to each of said auto tune devices via said communications bus and sends electrical current to each of said auto tune devices via said electrical current distribution bus and said electrical switching device, f. wherein each said electrical current sensing device send an indication of an amount of electrical current each respectively associated auto tune device is using and when said electrical current is sensed to be at a maximum level for each respective said auto tune device, said software program will send a command to said electrical switching device to turn off said electrical current to said respective auto tune device being sent the maximum level of electrical current, and g. wherein said software program determines that when electrical current has been turned off of all of said auto tune devices said musical drum instrument is declared to be in tune and each auto tune device is exerting the maximum tension to said tension assemblies thereby placing said musical drum instrument in tune.

2. The combination of claim 1 where said drum musical instrument contains one hoop securing said drum surface to said drum musical instrument.

3. The combination of claim 1, wherein said at least one hoop comprises a first hoop securing a first drum surface to a top of said drum musical instrument and a second hoop securing a second drum surface to a bottom of said drum musical instrument.

4. A method for tuning a musical drum instrument comprising the steps of:

providing a drum body;

providing one or more hoops holding one or more respective drum surfaces to said drum body;

providing a computing device;

providing a first software program;

providing a communications bus;

providing an electrical current distribution bus;

providing an electrical switching device; and providing a plurality of auto tune devices each said auto tune device comprising a respective tensioning assembly;

providing an electrical current sensing device corresponding to each auto tune device;

a. sending commands with said first software program to said electrical switching device via said communications bus on application of electrical current to said computing device to apply electrical current to each of said auto tune devices and sending commands to each of said auto tune devices via said communications bus to remove tension on each said tensioning assembly associated with a respective one of said auto tune devices thereby reducing tension on the one or more hoops holding the respective one or more drum surfaces thereby removing tension from said one or more drum surfaces;

b. monitoring, with said first software program, the amount of electrical current being sent to each of said auto tune devices and when the first software program determines that the amount of electrical current being provided to any one or more of said auto tune devices indicates that said one or more auto tune device is not providing output torque, turning off, with said first software program, said electrical current to said one or more auto tune device by sending a command via said first communications bus to said electrical switching device to terminate electrical current to said one or more auto tune devices that are not providing torque;

c. sending commands, with said first software program via said first communications bus to said electrical switching device when all of said auto tune devices are no longer receiving electrical current to apply electrical current to each of said auto tune devices, wherein said first software program sends commands to each of said auto tune devices via said first communications bus to send electricity to each auto tune device thereby generating torque in each of said associated tension assemblies;

d. monitoring, with said first software program, data from each of said associated electrical current sensing devices regarding the amount of electrical current being used by each of said auto tune devices received from each of said associated electrical current sensing devices, wherein when any one of the electrical current sensing devices indicates that, a respective auto tune device is using a maximum amount of electrical current to provide torque to its associated tensioning assembly, said first software program sends a command to said electrical switching device to terminate electrical current to that respective auto tune device, and e. wherein when said first software program has terminated electrical current to each of said auto tune devices the musical drum instrument is declared to be in tune.

5. A method for continuously tuning a musical drum instrument while it is being played comprising the steps of:

providing a drum body;

providing one or more hoops holding drum surfaces to said drum body;

providing a computing device;

providing a software program;

providing a communications bus;

providing an electrical current distribution bus;

providing a plurality of auto tune devices;

providing a plurality of electrical current sensing devices, each electrical sensing device associated with one of said plurality of auto tune devices;

providing an electrical switching device;

providing a plurality of tensioning assemblies, each tensioning assembly associated with one of said plurality of auto tune device;

a. initiating a tuning process that sequentially tunes each of said auto tune devices with said software program upon application of electrical current to said computing device, said tuning process comprising the steps of:

i. sending commands with said software program, to said electrical switching device via said communications bus to apply electrical current to each of said auto tune devices, wherein said software program sequentially sends a command to each auto tune device via said communications bus to increase the torque applied to a respective one of said plurality of associated tensioning assemblies;

ii. monitoring, with said software program, an amount of electrical current being used by each auto tune device received from a respective one of the said plurality of associated electrical current sensing devices, wherein when each said associated electrical sensing device indicates that said respective associated auto tune device is using a maximum amount of electrical current to provide torque to said respective associated tensioning assembly, said software program sends a command to said electrical switching device via said communications bus terminating electrical current to said each said respective associated auto tune device, wherein iii. when said software program has terminated electrical current to all said auto tune devices the musical drum instrument is declared to be in tune, and wherein iv. said tuning process is periodically repeated until a musician terminates current to said auto tune devices and to said computing device.

6. The method of claim 5 where said tuning process is periodically initiated by said software program on a fixed time period based on a predetermined number of seconds.

7. The method of claim 5 where a microphone is fixed to a shell of said musical drum instrument, wherein said software program monitors the output of said microphone, wherein when said software program determines that said one or more drum surfaces have not detected said musical drum instrument being struck for a predetermined number of seconds, based on input from said microphone, said software program initiates the tuning process.

* * * * *